US009228149B2

(12) United States Patent
Haque et al.

(10) Patent No.: US 9,228,149 B2
(45) Date of Patent: Jan. 5, 2016

(54) ENHANCED DURABILITY PERFORMANCE OF LUBRICANTS USING FUNCTIONALIZED METAL PHOSPHATE NANOPLATELETS

(71) Applicants: Tabassumul Haque, Annandale, NJ (US); Andy Haishung Tsou, Allentown, PA (US); Shuji Luo, Bridgewater, NJ (US); Martin N. Webster, Pennington, NJ (US)

(72) Inventors: Tabassumul Haque, Annandale, NJ (US); Andy Haishung Tsou, Allentown, PA (US); Shuji Luo, Bridgewater, NJ (US); Martin N. Webster, Pennington, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 232 days.

(21) Appl. No.: 13/928,687

(22) Filed: Jun. 27, 2013

(65) Prior Publication Data

US 2014/0011719 A1 Jan. 9, 2014

Related U.S. Application Data

(60) Provisional application No. 61/666,994, filed on Jul. 2, 2012.

(51) Int. Cl.
*C10M 125/24* (2006.01)

(52) U.S. Cl.
CPC ..... *C10M 125/24* (2013.01); *C10M 2201/085* (2013.01); *C10M 2203/1006* (2013.01); *C10M 2203/1025* (2013.01); *C10M 2205/00* (2013.01); *C10M 2205/0285* (2013.01); *C10M 2215/28* (2013.01); *C10N 2220/021* (2013.01); *C10N 2220/022* (2013.01); *C10N 2220/082* (2013.01); *C10N 2220/084* (2013.01); *C10N 2230/02* (2013.01); *C10N 2230/06* (2013.01); *C10N 2240/10* (2013.01); *C10N 2250/12* (2013.01)

(58) Field of Classification Search
CPC combination set(s) only.
See application file for complete search history.

(56) References Cited

U.S. PATENT DOCUMENTS

| | | | |
|---|---|---|---|
| 1,815,022 | A | 7/1931 | Davis |
| 2,015,748 | A | 10/1935 | Frolich |
| 2,191,498 | A | 2/1940 | Reiff |
| 2,387,501 | A | 10/1945 | Dietrich |

(Continued)

FOREIGN PATENT DOCUMENTS

| | | |
|---|---|---|
| CA | 1094044 | 1/1981 |
| EP | 0471071 | 8/1995 |

(Continued)

OTHER PUBLICATIONS

H. Spikes, The History and Mechanisms of ZDDP, Tribology Letters, 17(3), 2004, pp. 469-489.

(Continued)

*Primary Examiner* — Taiwo Oladapo
(74) *Attorney, Agent, or Firm* — Robert A. Migliorini

(57) ABSTRACT

A method for improving wear protection in an engine lubricated with a lubricating oil by using as the lubricating oil a formulated oil having a HTHS viscosity of less than 2.6 cP at 150° C. The formulated oil has a composition including a major amount of a lubricating oil base stock and a minor amount of metal phosphate nanoplatelets. The metal phosphate nanoplatelets are dispersed in the lubricating oil base stock sufficient for the formulated oil to pass wear protection requirements of one or more engine tests selected from TU3M, Sequence IIIG, Sequence IVA and OM646LA. Also provided are lubricating engine oil composition having improved wear protection.

18 Claims, 6 Drawing Sheets

(56) References Cited

U.S. PATENT DOCUMENTS

| | | | |
|---|---|---|---|
| 2,655,479 | A | 10/1953 | Munday et al. |
| 2,666,746 | A | 1/1954 | Munday et al. |
| 2,721,877 | A | 10/1955 | Popkin et al. |
| 2,721,878 | A | 10/1955 | Popkin |
| 3,036,003 | A | 5/1962 | Verdol |
| 3,087,936 | A | 4/1963 | LeSuer |
| 3,172,892 | A | 3/1965 | LeSuer et al. |
| 3,200,107 | A | 8/1965 | LeSuer |
| 3,215,707 | A | 11/1965 | Rense |
| 3,219,666 | A | 11/1965 | Norman et al. |
| 3,250,715 | A | 5/1966 | Wyman |
| 3,254,025 | A | 5/1966 | LeSuer |
| 3,272,746 | A | 9/1966 | LeSuer et al. |
| 3,275,554 | A | 9/1966 | Wagenaar |
| 3,316,177 | A | 4/1967 | Dorer, Jr. |
| 3,322,670 | A | 5/1967 | Burt et al. |
| 3,329,658 | A | 7/1967 | Fields |
| 3,341,542 | A | 9/1967 | LeSuer et al. |
| 3,382,291 | A | 5/1968 | Brennan |
| 3,413,347 | A | 11/1968 | Worrel |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | van der Voort et al. |
| 3,519,565 | A | 7/1970 | Coleman |
| 3,541,012 | A | 11/1970 | Stuebe |
| 3,545,607 | A | 12/1970 | Keller |
| 3,565,804 | A | 2/1971 | Honnen et al. |
| 3,630,904 | A | 12/1971 | Musser et al. |
| 3,632,511 | A | 1/1972 | Liao |
| 3,652,616 | A | 3/1972 | Watson et al. |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman |
| 3,703,536 | A | 11/1972 | Piasek et al. |
| 3,704,308 | A | 11/1972 | Piasek et al. |
| 3,725,277 | A | 4/1973 | Worrel |
| 3,725,480 | A | 4/1973 | Traise et al. |
| 3,726,822 | A | 4/1973 | von Bonin et al. |
| 3,726,882 | A | 4/1973 | Traise et al. |
| 3,742,082 | A | 6/1973 | Brennan |
| 3,751,365 | A | 8/1973 | Piasek et al. |
| 3,755,433 | A | 8/1973 | Miller |
| 3,756,953 | A | 9/1973 | Piasek et al. |
| 3,769,363 | A | 10/1973 | Brennan |
| 3,787,374 | A | 1/1974 | Adams |
| 3,798,165 | A | 3/1974 | Piasek et al. |
| 3,803,039 | A | 4/1974 | Piasek et al. |
| 3,822,209 | A | 7/1974 | Knapp et al. |
| 3,876,720 | A | 4/1975 | Heilman et al. |
| 3,948,800 | A | 4/1976 | Meinhardt |
| 4,100,082 | A | 7/1978 | Clason et al. |
| 4,149,178 | A | 4/1979 | Estes |
| 4,218,330 | A | 8/1980 | Shubkin |
| 4,234,435 | A | 11/1980 | Meinhardt et al. |
| 4,239,930 | A | 12/1980 | Allphin et al. |
| 4,367,352 | A | 1/1983 | Watts, Jr. et al. |
| 4,413,156 | A | 11/1983 | Watts, Jr. et al. |
| 4,426,305 | A | 1/1984 | Malec |
| 4,434,408 | A | 2/1984 | Baba et al. |
| 4,454,059 | A | 6/1984 | Pindar et al. |
| 4,476,551 | A | 10/1984 | Ruehle |
| 4,798,684 | A | 1/1989 | Salomon |
| 4,827,064 | A | 5/1989 | Wu |
| 4,827,073 | A | 5/1989 | Wu |
| 4,910,355 | A | 3/1990 | Shubkin et al. |
| 4,956,122 | A | 9/1990 | Watts et al. |
| 5,068,487 | A | 11/1991 | Theriot |
| 5,084,197 | A | 1/1992 | Galic et al. |
| 5,705,458 | A | 1/1998 | Roby et al. |
| 5,824,627 | A | 10/1998 | McConnachie et al. |
| 5,837,657 | A | 11/1998 | Fang et al. |
| 5,906,968 | A | 5/1999 | McConnachie et al. |
| 6,010,987 | A | 1/2000 | Stiefel et al. |
| 6,034,039 | A | 3/2000 | Gomes et al. |
| 6,110,878 | A | 8/2000 | McConnachie et al. |
| 6,143,701 | A | 11/2000 | Boffa |
| 6,153,564 | A | 11/2000 | Arunasalam et al. |
| 6,232,276 | B1 | 5/2001 | Stiefel et al. |
| 6,569,820 | B2 | 5/2003 | McConnachie et al. |
| 6,689,725 | B1 | 2/2004 | Gao |
| 6,730,638 | B2 | 5/2004 | Farng et al. |
| 6,734,150 | B2 | 5/2004 | Gao et al. |
| 2008/0312111 | A1* | 12/2008 | Malshe et al. ..... 508/155 |
| 2011/0046027 | A1 | 2/2011 | Zhamu et al. |
| 2011/0124536 | A1* | 5/2011 | Matsui ..... 508/110 |

FOREIGN PATENT DOCUMENTS

| | | | |
|---|---|---|---|
| JP | 03200897 | A * | 9/1991 |
| WO | 9826030 | | 6/1998 |
| WO | 9947629 | | 9/1999 |
| WO | 9966013 | | 12/1999 |
| WO | 2006026009 | A2 | 3/2006 |
| WO | 2006119502 | A2 | 11/2006 |
| WO | 2009014685 | A1 | 1/2009 |
| WO | 2011090718 | A2 | 7/2011 |

OTHER PUBLICATIONS

PCT Application No. PCT/US2013/048469, Communication from the International Searching Authority, Form PCT/ISA/210, dated Jun. 28, 2013, 4 pages.

* cited by examiner

ENHANCED DURABILITY PERFORMANCE OF LUBRICANTS USING FUNCTIONALIZED METAL PHOSPHATE NANOPLATELETS

CROSS-REFERENCE TO RELATED APPLICATIONS

This application claims the benefit of U.S. Provisional Application Ser. No. 61/666,994, filed on Jul. 2, 2012; which is incorporated herein in its entirety by reference.

FIELD

This disclosure relates to lubricating engines using formulated lubricating oils to reduce wear and improve engine fuel efficiency. The formulated lubricating oils contain a major amount of a lubricating oil base stock and a minor amount of metal phosphate nanoplatelets. The metal phosphate nanoplatelets are dispersed in the lubricating oil such that the lubricating oil exhibits improved antiwear performance and improved engine fuel efficiency.

BACKGROUND

Fuel efficiency requirements for passenger vehicles are becoming increasingly more stringent. New legislation in the United States and European Union within the past few years has set fuel economy and emissions targets not readily achievable with today's vehicle and lubricant technology. In order to improve lubricant fuel economy performance, reduction of viscosity is typically the best path; however, present day lubricant oils with a HTHS (ASTM D4683) viscosity of less than 2.6 cP at 150° C. would not be expected to be able to provide acceptable passenger vehicle engine durability performance.

HTHS is the measure of a lubricant's viscosity under conditions that simulate severe engine operation. Under high temperatures and high stress conditions, lubricant degradation can occur. As this happens, the viscosity of the lubricant decreases which may lead to increased engine wear. Antiwear additives are typically added to lubricant formulations to reduce engine wear. Illustrative antiwear additives include, for example, zinc dialkyldithiophosphate (ZDDP), zinc dithiocarbamates, molybdenum dialkyldithiophosphates, molybdenum dithiocarbamates, other organo molybdenum-nitrogen complexes, sulfurized olefins, etc.

ZDDP is an antiwear additive almost universally used in engine lubricants for the last 60 years. See Spikes, H., 2004, The History and Mechanisms of ZDDP, Tribology Letters, 17(3), p. 469-489. ZDDP provides wear protection under mild wear conditions. The negative aspect of ZDDP is that it generates volatile phosphorus which appears to be the major cause of poisoning the catalytic converter of the engine exhaust system.

Environmental regulations limit the level of phosphorous in the current lubricant formulations. As a result, the Original Equipment Manufacturers (OEMs) are under constant pressure in finding alternative antiwear technologies that can deliver no or less volatile phosphorus in the engine emission system.

Fuel economy improvement strongly depends on the reduction of lubricant viscosity. This leads the contact conditions to be more severe and thereby results in more engine wear. There is a need to develop effective antiwear technologies for the low viscosity lubricants that are compliant with environmental regulations.

Despite the advances in lubricant oil formulation technology, there exists a need for an engine oil lubricant that provides superior antiwear performance and effectively improves fuel economy, and has the capability to do so through reduction or removal of antiwear additives, e.g., ZDDP, that generate volatile phosphorus.

SUMMARY

This disclosure relates in part to a method for improving antiwear performance of a lubricating oil, and thereby improving fuel efficiency, in an engine lubricated with a lubricating oil by using metal phosphate nanoplatelets, e.g., zirconium phosphate (ZrP) nanoplatelets, dispersed in the lubricating oil, sufficient for the lubricating oil to exhibit improved antiwear performance. ZrP is synthetic layered alpha crystals having high thermal and chemical stability. The phosphorus in ZrP is a part of the metal phosphate crystals and cannot be removed until the destruction of the crystals. Hence, phosphorus in ZrP is stable and not volatile as compared to ZDDP. This is beneficial in achieving improved antiwear performance without compromising the performance of the engine exhaust system.

This disclosure also relates in part to a method for improving wear protection in an engine lubricated with a lubricating oil by using as the lubricating oil a formulated oil having a HTHS viscosity of less than 2.6 cP at 150° C. The formulated oil has a composition comprising a major amount of a lubricating oil base stock and a minor amount of metal phosphate nanoplatelets. The metal phosphate nanoplatelets are dispersed in the lubricating oil base stock sufficient for the formulated oil to pass wear protection requirements of one or more engine tests selected from TU3M, Sequence IIIG, Sequence IVA and OM646LA.

This disclosure further relates in part to a lubricating engine oil having a composition comprising a major amount of a lubricating oil base stock and a minor amount of metal phosphate nanoplatelets. The lubricating engine oil has a HTHS viscosity of less than 2.6 cP at 150° C. The metal phosphate nanoplatelets are dispersed in the lubricating oil base stock sufficient for the lubricating engine oil to pass wear protection requirements of one or more engine tests selected from TU3M, Sequence IIIG, Sequence IVA and OM646LA.

This disclosure yet further relates in part to a method of improving wear protection in an engine lubricated with a lubricating oil. The method comprises using as the lubricating oil a formulated oil comprising a lubricating oil base stock as a major component and metal phosphate nanoplatelets as a minor component. The metal phosphate nanoplatelets are dispersed in the lubricating oil base stock. Wear protection is improved as compared to wear protection achieved using a lubricating oil containing a minor component other than the metal phosphate nanoplatelets.

This disclosure also relates in part to a lubricating engine oil having a composition comprising a lubricating oil base stock as a major component and metal phosphate nanoplatelets as a minor component. The metal phosphate nanoplatelets are dispersed in the lubricating oil base stock sufficient for the lubricating engine oil to exhibit improved wear protection as compared to wear protection achieved using a lubricating oil containing a minor component other than the metal phosphate nanoplatelets.

In accordance with this disclosure, an engine oil lubricant provides superior antiwear performance and effectively improves fuel economy, and has the capability to do so through reduction or removal of antiwear additives, e.g., ZDDP, that generate volatile phosphorus. Engine wear protection is maintained even at lower HTHS viscosities, e.g., 2.6 cP or lower at 150° C.

Other objects and advantages of the present disclosure will become apparent from the detailed description that follows.

DETAILED DESCRIPTION

Figure 1:
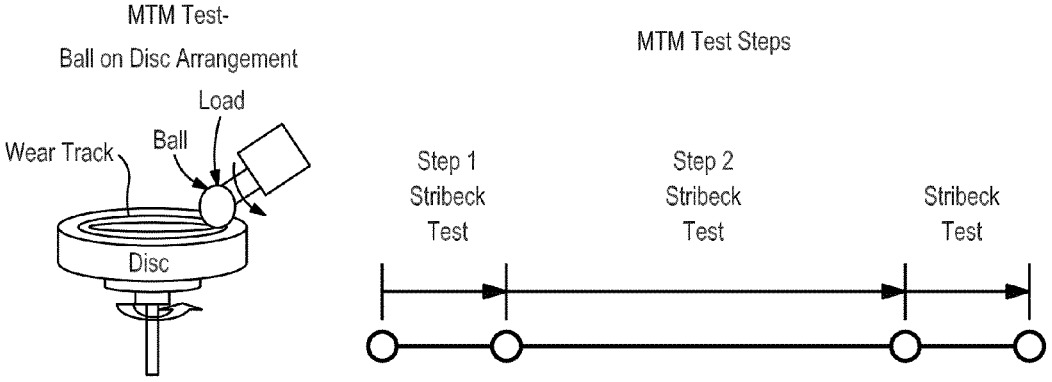
FIG. 1 depicts the semantics of the Mini Traction Machine (MTM) ball on disc arrangement and testing steps.

All numerical values within the detailed description and the claims herein are modified by "about" or "approximately" the indicated value, and take into account experimental error and variations that would be expected by a person having ordinary skill in the art.

It has now been found that improved wear protection and fuel efficiency can be attained in an engine lubricated with a lubricating oil by using as the lubricating oil a formulated oil having a HTHS viscosity of less than 2.6 cP at 150° C. The formulated oil comprises a major amount of a lubricating oil base stock and a minor amount of metal phosphate nanoplatelets. The metal phosphate nanoplatelets are dispersed in the lubricating oil base stock sufficient for the lubricating engine oil to pass wear protection requirements of one or more engine tests selected from TU3M, Sequence IIIG, Sequence IVA and OM646LA. The lubricating oils of this disclosure are particularly advantageous as passenger vehicle engine oil (PVEO) products.

The lubricating oils of this disclosure provide excellent engine protection including antiwear performance. This benefit can be demonstrated for the lubricating oils of this disclosure in the Sequence IIIG/IIIGA (ASTM D7320), Sequence IVA (ASTM D6891), PSA TU3MS (CEC L-038-94), MB OM646LA (CEC L-099-08), and Caterpillar 1M-PC (ASTM D6618) engine tests at HTHS viscosities less than 2.6 cP (at 150° C.). The lubricating oils of this disclosure provide improved fuel efficiency. A lower HTHS viscosity engine oil generally provides superior fuel economy to a higher HTHS viscosity product. This benefit can be demonstrated for the lubricating oils of this disclosure in the MB M111 Fuel Economy (CEC L-054-96) and Sequence VID Fuel Economy (ASTM D7589) engine tests. By providing outstanding engine protection at very low HTHS viscosities, this disclosure provides improved fuel economy without sacrificing engine durability.

The engine lubricating oils of this disclosure include both low viscosity fuel economy oils, e.g., passenger vehicle lubricants (PVL) and commercial vehicle lubricants (CVL), and also high viscosity and high performance industrial oils.

The low viscosity fuel economy, engine lubricating oils of the present disclosure have a HTHS viscosity of less than 2.6 cP at 150° C., preferably less than 2.4 cP at 150° C., and more preferably less than 2.2 cP at 150° C. The low viscosity fuel economy, lubricating engine oils of this disclosure have a composition sufficient to pass wear protection requirements of one or more engine tests selected from TU3M, Sequence IIIG, Sequence IVA, OM646LA and others.

The high viscosity and high performance industrial oils of this disclosure have a kinematic viscosity at 40° C. of from 12 cSt to 800 cSt depending on the ISO VG grade. The kinematic viscosity is determined by the capillary tube viscometer test method as described in ASTM D445 and ISO 3104. For most industrial oils, it is common to measure kinematic viscosity at 40° C. because this is the basis for the ISO viscosity grading system (ISO 3448).

The lubricating engine oils of this disclosure can also be useful for applications irrespective of viscosity grade and/or base stock type. For example, the lubricating engine oils of this disclosure can be useful in marine, aviation, and industrial engine and machine components.

Lubricating Oil Base Stocks

A wide range of lubricating base oils is known in the art. Lubricating base oils that are useful in the present disclosure are both natural oils, and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org) to create guidelines for lubricant base oils. Group I base stocks have a viscosity index of between 80 to 120 and contain greater than 0.03% sulfur and/or less than 90% saturates. Group II base stocks have a viscosity index of between 80 to 120, and contain less than or equal to 0.03% sulfur and greater than or equal to 90% saturates. Group III stocks have a viscosity index greater than 120 and contain less than or equal to 0.03% sulfur and greater than 90% saturates. Group IV includes polyalphaolefins (PAO). Group V base stock includes base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefins (PAO) and GTL products | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred.

Mineral oils vary widely as to their crude source, for example, as to whether they are paraffinic, naphthenic, or mixed paraffinic-naphthenic. Oils derived from coal or shale are also useful. Natural oils vary also as to the method used for their production and purification; for example, their distillation range and whether they are straight run or cracked, hydrorefined, or solvent extracted.

Group II and/or Group III hydroprocessed or hydrocracked basestocks, including synthetic oils such as polyalphaolefins, alkyl aromatics and synthetic esters are also well known basestock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from 250 to 3,000, although PAO's may be made in viscosities up to 100 cSt (100° C.). The PAOs are typically comprised of relatively low molecular weight hydrogenated polymers or oligomers of alphaolefins which include, but are not limited to, $C_2$ to $C_{32}$ alphaolefins with the $C_8$ to $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity basestocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

The hydrocarbyl aromatics can be used as base oil or base oil component and can be any hydrocarbyl molecule that contains at least 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from $C_6$ up to $C_{60}$ with a range of $C_8$ to $C_{20}$ often being preferred. A mixture of hydrocarbyl groups is often preferred, and up to three such substituents may be present. The hydrocarbyl group can optionally contain sulfur, oxygen, and/or nitrogen containing substituents. The aromatic group can also be derived from natural (petroleum) sources, provided at least 5% of the molecule is comprised of an above-type aromatic moiety. Viscosities at 100° C. of approximately 3 cSt to 50 cSt are preferred, with viscosities of approximately 3.4 cSt to 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be 2% to 25%, preferably 4% to 20%, and more preferably 4% to 15%, depending on the application.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from 5 to 10 carbon atoms. These esters are widely available commercially, for example, the Mobil P-41 and P-51 esters of ExxonMobil Chemical Company).

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from 2 $mm^2/s$ to 50 $mm^2/s$ (ASTM D445). They are further characterized typically as having pour points of −5° C. to −40° C. or lower (ASTM D97). They are also characterized typically as having viscosity indices of 80 to 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) and hydrodewaxed, or hydroisomerized/cat (and/or solvent) dewaxed base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low sulfur, sulfated ash, and phosphorus (low SAP) products.

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluents/carrier oil for additives used on an "as-received" basis. Even in regard to the Group II stocks, it is preferred that the Group II stock be in the higher quality range associated with that stock, i.e. a Group II stock having a viscosity index in the range 100<VI<120.

The base oil constitutes the major component of the engine oil lubricant composition of the present disclosure and typically is present in an amount ranging from 50 to 99 weight percent, preferably from 70 to 95 weight percent, and more preferably from 85 to 95 weight percent, based on the total weight of the composition. The base oil may be selected from any of the synthetic or natural oils typically used as crankcase lubricating oils for spark-ignited and compression-ignited engines. The base oil conveniently has a kinematic viscosity, according to ASTM standards, of 2.5 cSt to 12 cSt (or $mm^2/s$) at 100° C. and preferably of 2.5 cSt to 9 cSt (or $mm^2/s$) at 100° C. Mixtures of synthetic and natural base oils may be used if desired.

Metal Phosphate Nanoplatelets

Metal phosphate nanoplatelets, e.g., zirconium phosphate (ZrP) nanoplatelets, are an essential component of the lubricating oils of this disclosure. The metal phosphate nanoplatelets dispersed in a lubricating oil, e.g., polyalphaolefin (PAO), base stock provide excellent wear protection on ferrous surfaces under boundary lubrication conditions. The metal phosphate nanoplatelets are conventional materials known in the art.

ZrP is synthetic layered alpha crystals having high thermal and chemical stability. The phosphorus in ZrP is a part of the metal phosphate crystals and cannot be removed until the destruction of the crystals. Hence, phosphorus in ZrP is stable and not volatile as compared to ZDDP. This is beneficial in achieving improved antiwear performance without compromising the performance of the engine exhaust system.

The metal phosphate nanoplatelets are in the form of platelets having an aspect ratio of 50 or more, 100 or more, or 150 or more. The phosphate can be a metal phosphate such as alpha-zirconium phosphate, titanium phosphate, or the like. Metal phosphate nanoplatelets are commercially available and can be prepared by conventional methods.

It is important that the metal phosphate nanoplatelets are dispersed in the lubricating oil sufficient for the lubricating oil to exhibit improved antiwear performance.

In one embodiment, amorphous polypropylene (aPP) polymers can be grafted with ZrP nanoplatelets to help them disperse in PAO. This additive may provide controlled running-in (polishing) wear but prevents any progressive abrasive (plowing) and adhesive (scuffing) wear in the steady state conditions.

The surface grafted hydrocarbon polymers can be homopolymers, random copolymers, or block copolymers, and should be amorphous in nature and have molecular weight below 25,000, more preferably below 20,000, and most preferably below 10,000. The hydrocarbon portion of the copolymers is preferred to consist of linear alpha olefin.

In another embodiment, a long chain hydrocarbyl dispersant containing oleophilic portion and polyamino segment can be used for ZrP dispersion in the lubricating oil. For example, polyisobutylene succinimide polyamine (PIBSA-PAM) dispersant can be used to disperse ZrP in PAO through the surface attachment. This additive can form 50 nm thick tribofilm within the wear track giving no measurable wear. Other dispersants described herein may also be useful for dispersing ZrP in the lubricating oil.

The metal phosphate nanoplatelets are typically used in amounts of from 0.1 weight percent to 10 weight percent, preferably from 0.1 weight percent to 7.5 weight percent, and more preferably from 0.1 weight percent to 5.0 or 3.0 weight percent, based on the total weight of the lubricating oil, although more or less can often be used advantageously. The amount used should be sufficient to achieve greater or equal wear resistance than the wear resistance obtained with ZDDP antiwear additive.

Other Additives

The formulated lubricating oil useful in the present disclosure may additionally contain one or more of the other commonly used lubricating oil performance additives including but not limited to dispersants, detergents, corrosion inhibitors, rust inhibitors, metal deactivators, other anti-wear agents and/or extreme pressure additives, anti-seizure agents, wax modifiers, viscosity index improvers, viscosity modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973).

The types and quantities of performance additives used in combination with the instant disclosure in lubricant compositions are not limited by the examples shown herein as illustrations.

Dispersants

During engine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So-called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,214,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between hydrocarbyl substituted succinic anhydrides and amines Molar ratios can vary depending on the polyamine. For example, the molar ratio of hydrocarbyl substituted succinic anhydride to TEPA can vary from 1:1 to 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from 0.1 to 5 moles of boron per mole of dispersant reaction product.

Mannich base dispersants are made from the reaction of alkylphenols, formaldehyde, and amines See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or HN®$_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 500 to 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of 0.1 to 20 weight percent, preferably 0.5 to 8 weight percent.

Detergents

A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stoichiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of 1.05:1 to 50:1 on an equivalent basis. More preferably, the ratio is from 4:1 to 25:1. The resulting detergent is an overbased detergent that will typically have a TBN of 150 or higher, often 250 to 450 or more. Preferably, the overbasing cation is sodium, calcium, or magnesium. A mixture of detergents of differing TBN can be used in the present disclosure.

Preferred detergents include the alkali or alkaline earth metal salts of sulfonates, phenates, carboxylates, phosphates, and salicylates, e.g., a mixture of magnesium sulfonate and calcium salicylate.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have 3 to 70 carbon atoms. The alkaryl sulfonates typically contain 9 to 80 carbon or more carbon atoms, more typically from 16 to 60 carbon atoms.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

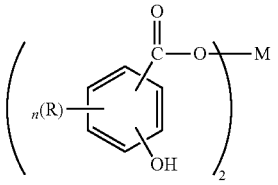

where R is an alkyl group having 1 to 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents and are known in the art.

Detergents may be simple detergents or what is known as hybrid or complex detergents. The latter detergents can provide the properties of two detergents without the need to blend separate materials. See U.S. Pat. No. 6,034,039.

Preferred detergents include calcium phenates, calcium sulfonates, calcium salicylates, magnesium phenates, magnesium sulfonates, magnesium salicylates and other related components (including borated detergents) in any combination. A preferred detergent includes magnesium sulfonate and calcium salicylate.

The detergent concentration in the lubricating oils of this disclosure can range from 1.0 to 6.0 weight percent, preferably 2.0 to 5.0 weight percent, and more preferably from 2.0 weight percent to 4.0 weight percent, based on the total weight of the lubricating oil.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to 20 carbon atoms, and preferably contains from 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least 6 carbon atoms. Examples of aliphatic groups include hexyl, heptyl, octyl, nonyl, and decyl. Generally, the aliphatic groups will not contain more than 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alphanaphthylamine; phenyl-alpha-naphthylamine; and p-octylphenyl-alphanaphthylamine.

Sulfurized alkyl phenols and alkali or alkaline earth metal salts thereof also are useful antioxidants.

Preferred antioxidants include hindered phenols, arylamines. These antioxidants may be used individually by type or in combination with one another. Such additives may be used in an amount of 0.01 to 5 weight percent, preferably 0.01 to 1.5 weight percent, more preferably zero to less than 1.5 weight percent, most preferably zero.

Pour Point Depressants (PPDs)

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2,721,878; and 3,250,715 describe useful pour point depressants and/or the preparation thereof. Such additives may be used in an amount of 0.01 to 5 weight percent, preferably 0.01 to 1.5 weight percent.

Seal Compatibility Agents

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of 0.01 to 3 weight percent, preferably 0.01 to 2 weight percent.

Antifoam Agents

Anti-foam agents may advantageously be added to lubricant compositions. These agents retard the formation of stable foams. Silicones and organic polymers are typical antifoam agents. For example, polysiloxanes, such as silicon oil or polydimethyl siloxane, provide antifoam properties. Antifoam agents are commercially available and may be used in conventional minor amounts along with other additives such as demulsifiers; usually the amount of these additives combined is less than 1 weight percent and often less than 0.1 weight percent.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure. Friction modifiers may include metal-containing compounds or materials as well as ashless compounds or materials, or mixtures thereof. Metal-containing friction modifiers may include metal salts or metalligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo (DTC), Mo-dithiophosphates, Mo (DTP), Mo-amines, Mo (Am), Mo-alcoholates, Mo-alcohol-amides, etc. See U.S. Pat. Nos. 5,824,627, 6,232,276, 6,153,564, 6,143,701, 6,110,878, 5,837,657, 6,010,987, 5,906,968, 6,734,150, 6,730,638, 6,689,725, 6,569,820; WO 99/66013; WO 99/47629; and WO 98/26030.

Ashless friction modifiers may also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from 0.01 weight percent to 10-15 weight percent or more, often with a preferred range of 0.1 weight percent to 5 weight percent. Concentrations of molybdenum-containing materials are often described in terms of Mo metal concentration. Advantageous concentrations of Mo may range from 10 ppm to 3000 ppm or more, and often with a preferred range of 20-2000 ppm, and in some instances a more preferred range of 30-1000 ppm. Friction modifiers of all types may be used alone or in mixtures with the materials of this disclosure. Often mixtures of two or more friction modifiers, or mixtures of friction modifier(s) with alternate surface active material(s), are also desirable.

Viscosity Index Improvers

Viscosity index improvers (also known as VI improvers, viscosity modifiers, and viscosity improvers) can be included in the lubricant compositions of this disclosure. Preferably, the method of this disclosure obtains improvements in fuel economy without sacrificing durability by a reduction of high-temperature high-shear (HTHS) viscosity to a level lower than 2.6 cP through reduction or removal of viscosity index improvers or modifiers.

Viscosity index improvers provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between 10,000 to 1,500,000, more typically 20,000 to 1,200,000, and even more typically between 50,000 and 1,000,000.

Examples of suitable viscosity index improvers are linear or star-shaped polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers, are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Polyisoprene polymers are commercially available from Infineum International Limited, e.g. under the trade designation "SV200"; diene-styrene copolymers are commercially available from Infineum International Limited, e.g. under the trade designation "SV 260".

In an embodiment of this disclosure, the viscosity index improvers may be used in an amount of less than 2.0 weight percent, preferably less than 1.0 weight percent, and more preferably less than 0.5 weight percent, based on the total weight of the formulated oil or lubricating engine oil.

In another embodiment of this disclosure, the viscosity index improvers may be used in an amount of from 0.0 to 2.0 weight percent, preferably 0.0 to 1.0 weight percent, and more preferably 0.0 to 0.5 weight percent, based on the total weight of the formulated oil or lubricating engine oil.

When lubricating oil compositions contain one or more of the additives discussed above, the additive(s) are blended into the composition in an amount sufficient for it to perform its intended function. Typical amounts of such additives useful in the present disclosure are shown in Table A below.

It is noted that many of the additives are shipped from the additive manufacturer as a concentrate, containing one or more additives together, with a certain amount of base oil diluents. Accordingly, the weight amounts in the table below, as well as other amounts mentioned in this specification, are directed to the amount of active ingredient (that is the non-diluent portion of the ingredient). The weight percent (wt %) indicated below is based on the total weight of the lubricating oil composition.

TABLE 1

Typical Amounts of Other Lubricating Oil Components

| Compound | Approximate wt % (Useful) | Approximate wt % (Preferred) |
|---|---|---|
| Dispersant | 0.1-20 | 0.1-8 |
| Detergent | 1.0-6.0 | 2.0-4.0 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Index Improver (solid polymer basis) | 0.0-2 | 0.0-1 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

The following non-limiting examples are provided to illustrate the disclosure.

EXAMPLES

Dispersion of α-ZrP Nanoplatelets in PAO

The following materials were used in the Examples. Alpha-zirconium phosphate (α-ZrP) is a water suspension (3.3 wt %) available from Rhodia. ZrP has the diameter of 150 nm and the thickness of 1 nm. Vinyl-terminated atactic polypropylene (aPP) was synthesized by a metallocene catalyst (depicted below) coupled with a non-coordinating anion activator. Mn is 1785 as determined by NMR. Polyisobutylene succinimide polyamine (PIBSA-PAM) is a commercial dispersant from Infinium. The metallocene catalyst used to synthesize vinyl-terminated aPP is represented by the formula

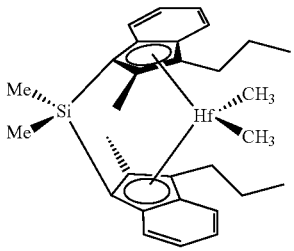

Preparation of aPP-α-ZrP

To a round-bottomed flask was charged 150 grams of a water suspension of α-ZrP and cysteamine hydrochloride (1.82 grams). The mixture was stirred at ambient temperature for 1 hour. A solution of vinyl-terminated aPP (4.76 grams) and 2,2'-azobis(2-methylpropionitrile) (AIBN, 0.18 grams) in o-xylene (200 milliliters) was then added. The flask was connected to a short distillation head with chilled water as the coolant and a receiver at the end. The reaction mixture was heated to 100° C. and water was gradually distilled out and collected in the receiver. After 27 hours, heat was removed and the mixture was allowed to cool down. The mixture was then stirred with methanol (200 milliliters) and centrifuged for 30 minutes (RPM 4500). After decanting the liquid phase, the solid was collected and dried in high vacuum overnight, yielding 6.5 grams of white solid. The synthesis is depicted as follows:

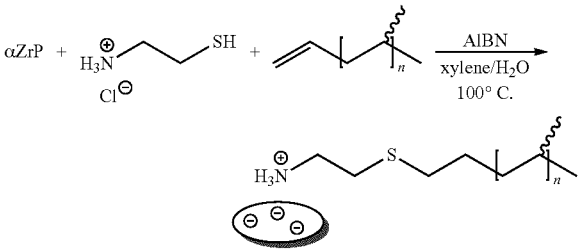

Dispersion aPP-α-ZrP in PAO 4

0.42 grams of aPP-α-ZrP prepared above was mixed with 20.55 grams of PAO 6 and sonicated for 6 hours at 50° C.

Dispersion of α-ZrP in PAO 4 Using PIBSA-PAM as Aid 250 grams of PAO 4 was mixed with 75.8 grams of a water suspension of alpha-zirconium phosphate and 2.5 grams of PIBSA-PAM (PIB Mn 1000). The mixture was sonicated at 50° C. for 6 hours and the water was removed by vacuum stripping. The reaction of alpha-zirconium phosphate with PIBSA-PAM is depicted as follows:

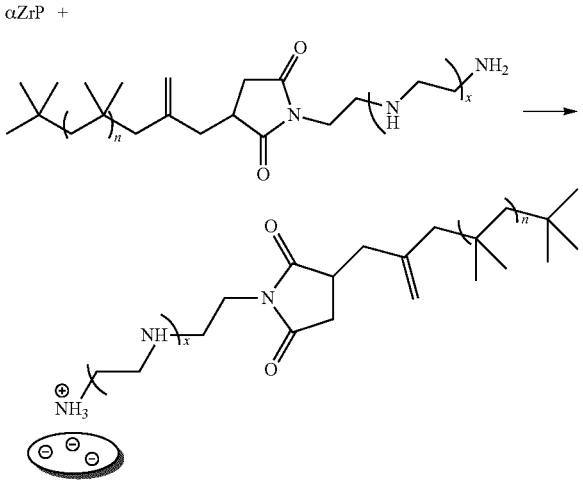

Tribological Tests

Friction and wear tests were performed in a Mini Traction Machine (MTM). This machine has a ball-on-disc arrangement where the speeds of ball and disc can be controlled independently. This helps simulate the sliding/rolling contact conditions. The rolling/sliding type of contact is commonly found in many machine/engine components such as gears and cams.

A standard steel ball was loaded against a standard steel disc with 37 N load that exerted approximately 1 GPa Hertzian contact pressure. See FIG. 1. The lubricant temperature was 100° C. while the mean entrainment speed and slide-roll-ratio (SRR) were 50 mm/s and 50% respectively. The test sequence involved 3 steps as illustrated in FIG. 1.

Long duration wear tests were performed in order to achieve the steady state friction response as well as film formation. The test lubricant and specimens were not changed until the entire test was completed. The MTM specimens were removed from the apparatus for wear analysis. To remove the residual oils prior to wear measurement, the MTM disc was cleaned using acetone followed by heptane. A Veeco Dektak 150 stylus profilometer was used to generate the 2D and 3D maps of the wear tracks (tribofilms).

Figure 2:
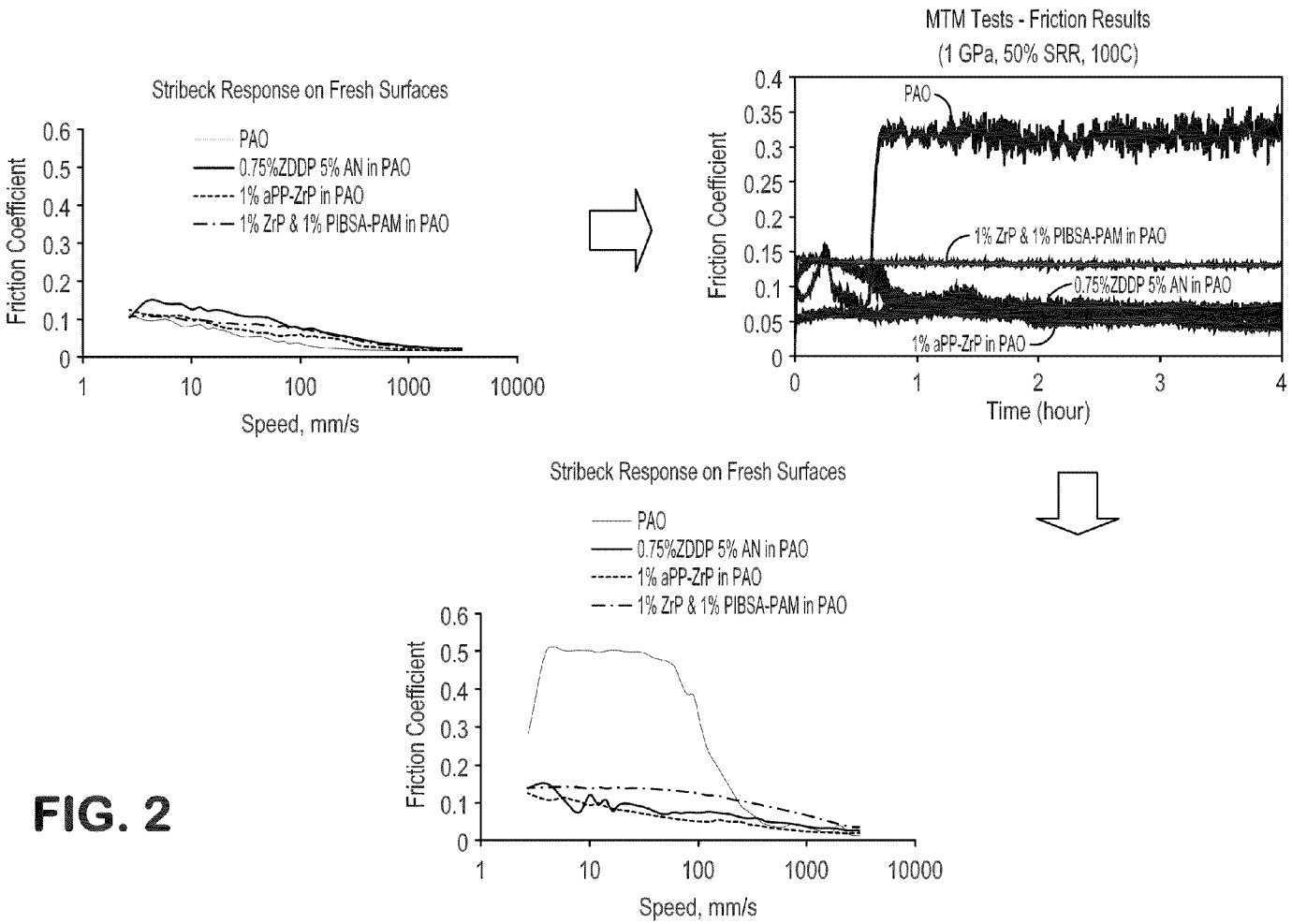
FIG. 2 graphically depicts MTM friction results from Stribeck and wear tests.

The following 4 lubricant formulations were used for the Stribeck and wear tests:

a. PAO Base Stock (viscosity grade 6)
b. 0.75% ZDDP 5% Alkylated Naphthalene (AN) in PAO
c. 1% aPP-ZrP in PAO
d. 1% ZrP & 1% PIBSA-PAM in PAO The friction results of Stribeck and 4-hour wear tests are shown in FIG. 2. The Stribeck tests performed on the fresh surfaces showed friction coefficients almost in the same range for all oils. However, the wear tests clearly showed a sudden increase in friction for PAO at around 45 minutes after starting the test. The Stribeck tests performed on the worn surfaces also revealed an early increase of friction for PAO while all other blends provided similar friction response. The increase in friction for PAO may attribute to a significant wear on the metal surfaces.

Figure 3:
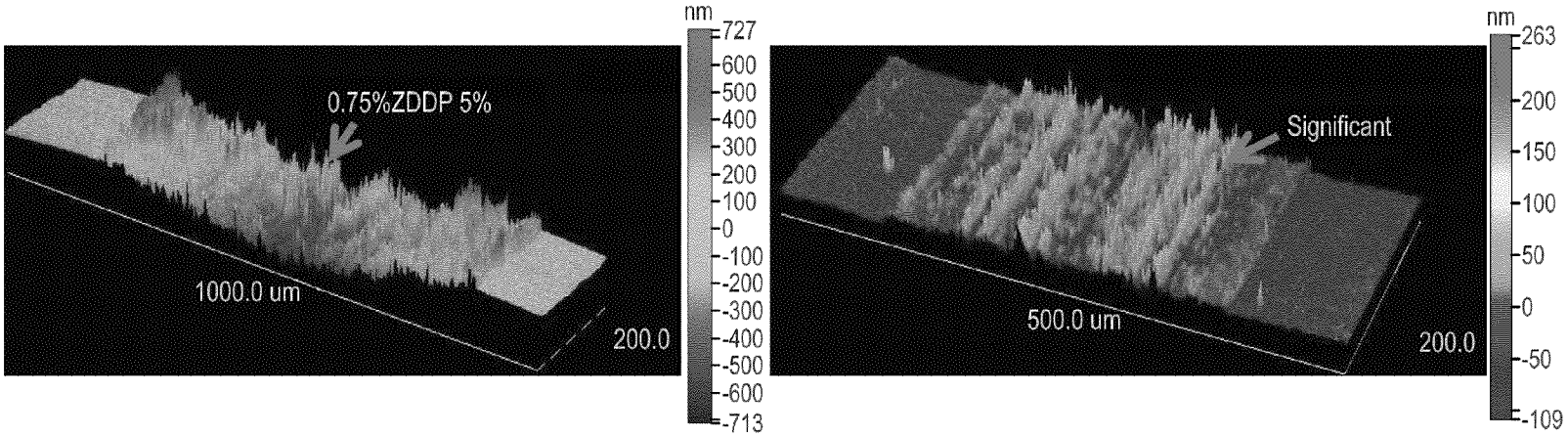
FIG. 3 depicts photomicrographs of 3D wear scar maps of (a) PAO and (b) 0.75% ZDDP and 5% AN in PAO.

Three dimensional maps of the wear tracks for PAO and ZDDP-containing PAO are shown in FIG. 3. It is evident from the images that the absence of antiwear additive in PAO resulted in a significant loss of material. The wear was primarily dominated by abrasive and adhesive wear. In contrast, ZDDP provided relatively thick tribofilm along the wear track as expected.

Figure 4:
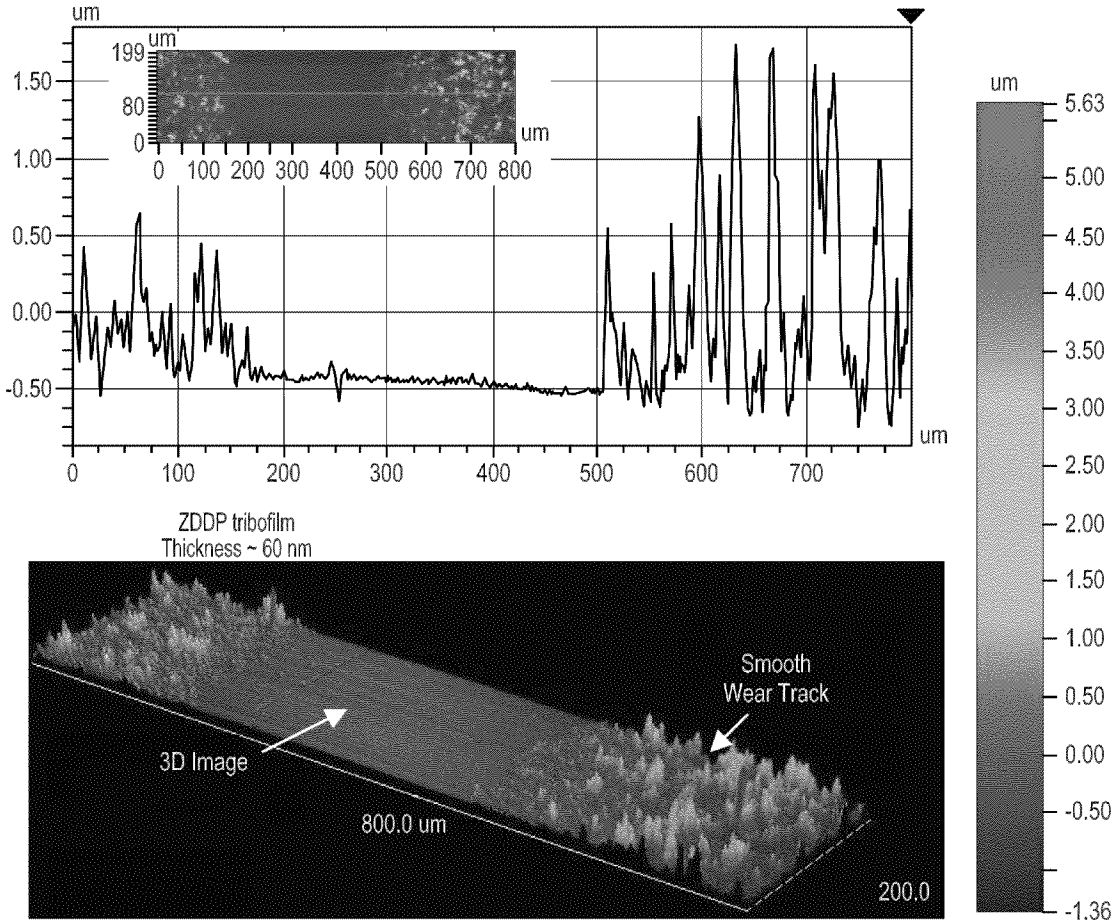
FIG. 4 depicts a graphical representation and photomicrograph of 2D and 3D wear scar maps for 1% aPP-ZrP in PAO.
Figure 5:
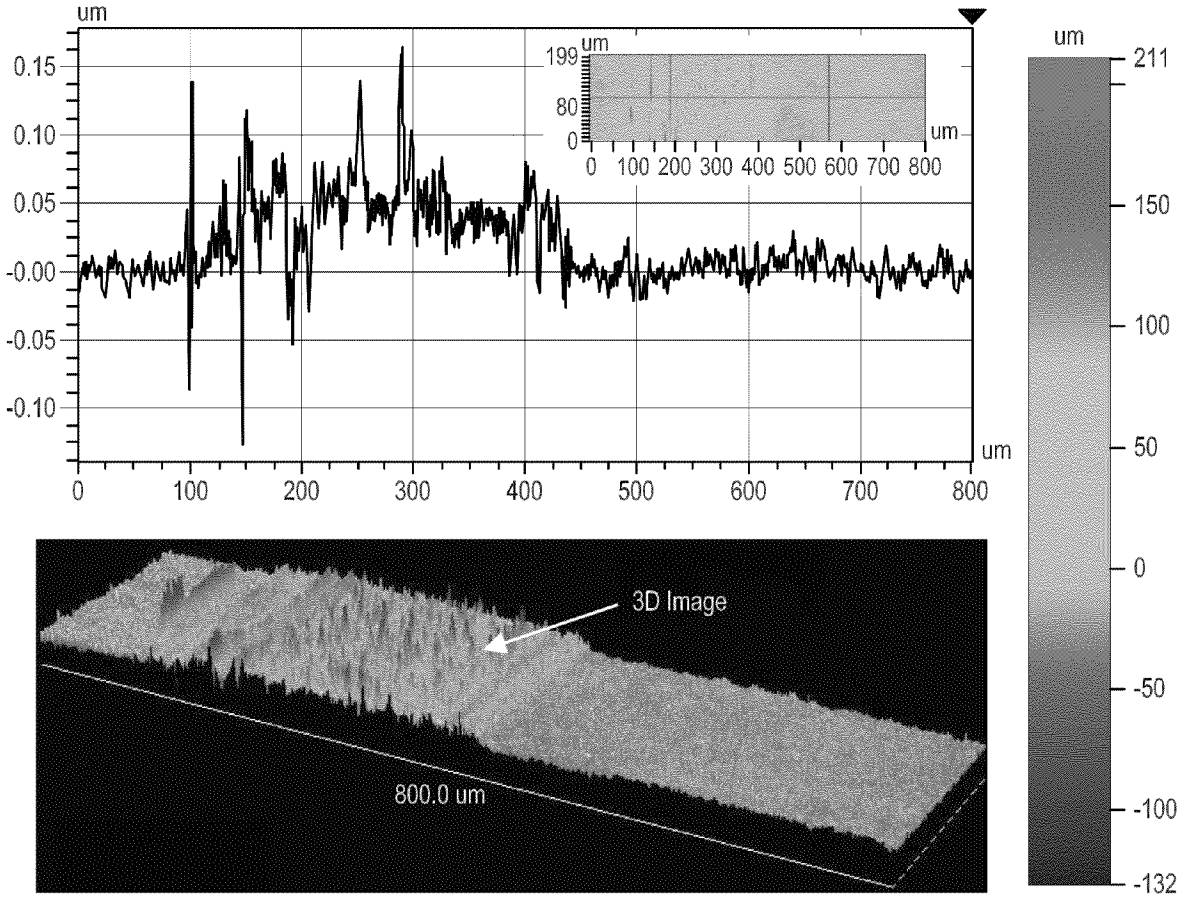
FIG. 5 depicts a graphical representation and photomicrograph of 2D and 3D wear scar maps for 1% ZrP and 1% PIBSA-PAM in PAO.

The wear scar maps for the blends containing aPP:ZrP and PIBSA-PAM:ZrP are shown in FIGS. 4 and 5. It is evident from the images that aPP:ZrP provided controlled polishing wear but prevented any aggressive wear (abrasive/adhesive) as opposed to what was found in the case of PAO. This demonstrates that the use of ZrP nanoplatelets improves the antiwear performance of lubricant products.

Large deposits of aPP:ZrP were found outside the wear track. This was probably because of the insufficient dispersion stability of aPP:ZrP in PAO. Interestingly, the dynamic action within the wear track prevented formation of any such deposit; rather, a dynamic formation and removal process of ZrP nanoplatelets within the wear track offered the improved wear resistance.

In order to improve the dispersion stability, PIBSA-PAM was used along with ZrP in PAO. The absence of deposits outside the wear track as shown in FIG. 5 clearly demonstrates the improvement in dispersion stability of the PIBSA-PAM:ZrP in PAO. In addition, a relatively thick and uniform tribofilm within the wear track was found.

SEM/EDX Analysis

Figure 6:
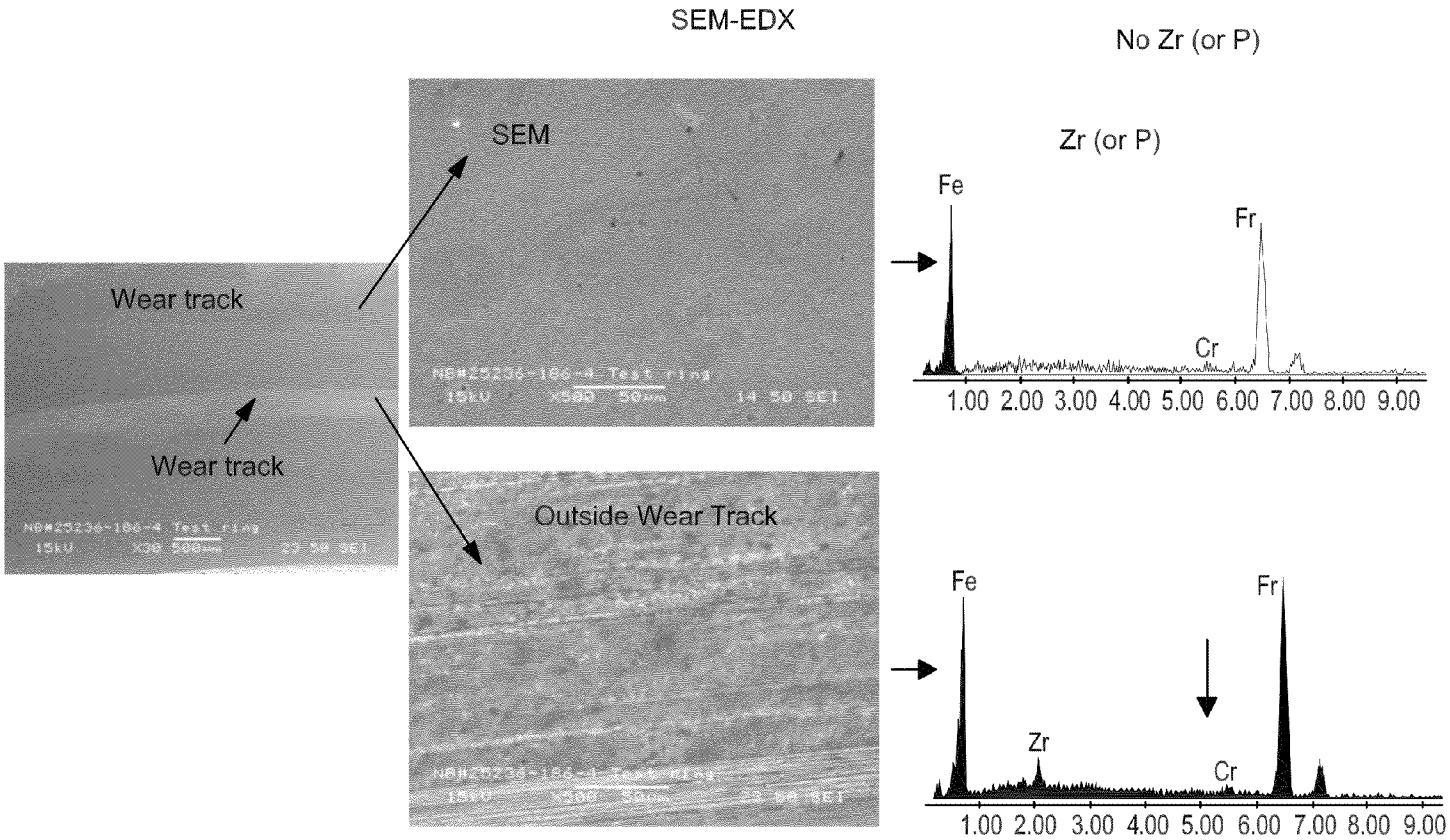
FIG. 6 depicts a graphical representations and photomicrographs of SEM/EDX analysis of tribofilms for 1% ZrP and 1% PIBSA-PAM in PAO.

The elemental analysis of tribofilm was performed using Scanning Electron Microscope/Energy Dispersive X-Ray (SEM-EDX). The results are shown in FIG. 6. The EDX spectra clearly show the presence of Zr and P within the wear track. In contrast, no Zr and P elements were found outside the wear track meaning that no thermal film was formed. Better dispersion helps get sufficient ZrP nanoplatelets at the tribological contact. ZrP tribofilm formation requires contact pressure and rubbing action (same as ZDDP).

PCT and EP Clauses:

1. A method for improving wear protection in an engine lubricated with a lubricating oil by using as the lubricating oil a formulated oil having a HTHS viscosity of less than 2.6 cP at 150° C., said formulated oil having a composition comprising a major amount of a lubricating oil base stock and a minor amount of metal phosphate nanoplatelets; wherein said metal phosphate nanoplatelets are dispersed in said lubricating oil base stock sufficient for the formulated oil to pass wear protection requirements of one or more engine tests selected from TU3M, Sequence IIIG, Sequence IVA and OM646LA.

2. The method of clause 1 wherein the lubricating oil base stock comprises a Group I, Group II, Group III, Group IV or Group V base oil.

3. The method of clauses 1 and 2 wherein the metal phosphate nanoplatelets comprise alpha zirconium phosphate (ZrP) nanoplatelets, wherein the alpha zirconium phosphate (ZrP) nanoplatelets comprise platy particles having diameters less than 1500 nm.

4. The method of clauses 1-3 wherein the alpha zirconium phosphate (ZrP) nanoplatelets are grafted with a hydrocarbon polymer to form hydrocarbon polymer nanoplates that are dispersed in said lubricating oil base stock; wherein the hydrocarbon polymer comprises a homopolymer, random copolymer or block copolymer that is amorphous and has a molecular weight below 25,000.

5. The method of clauses 1-4 wherein said formulated oil further comprises a long chain hydrocarbyl dispersant containing oleophilic portion and polyamino segment.

6. The method of clauses 1-5 wherein the oil base stock is present in an amount of from 70 weight percent to 95 weight percent, and the metal phosphate nanoplatelets are present in an amount of from 0.1 weight percent to 10 weight percent, based on the total weight of the formulated oil.

7. A method of improving wear protection in an engine lubricated with a lubricating oil, said method comprising using as the lubricating oil a formulated oil comprising a lubricating oil base stock as a major component and metal phosphate nanoplatelets as a minor component; wherein said metal phosphate nanoplatelets are dispersed in said lubricating oil base stock; and wherein wear protection is improved as compared to wear protection achieved using a lubricating oil containing a minor component other than said metal phosphate nanoplatelets.

8. A lubricating engine oil having a composition comprising a major amount of a lubricating oil base stock and a minor amount of metal phosphate nanoplatelets; wherein said lubricating engine oil has a HTHS viscosity of less than 2.6 cP at 150° C.; and wherein said metal phosphate nanoplatelets are dispersed in said lubricating oil base stock sufficient for the lubricating engine oil to pass wear protection requirements of one or more engine tests selected from TU3M, Sequence IIIG, Sequence IVA and OM646LA.

9. The lubricating engine oil of clause 8 wherein the lubricating oil base stock comprises a Group I, Group II, Group III, Group IV or Group V base oil.

10. The lubricating engine oil of clause 8 wherein the metal phosphate nanoplatelets comprise alpha zirconium phosphate (ZrP) nanoplatelets, wherein the alpha zirconium phosphate (ZrP) nanoplatelets comprise platy particles having diameters less than 1500 nm.

11. The lubricating engine oil of clauses 8-10 wherein the alpha zirconium phosphate (ZrP) nanoplatelets are grafted with a hydrocarbon polymer to form hydrocarbon polymer nanoplates that are dispersed in said lubricating oil base stock; wherein the hydrocarbon polymer comprises a homopolymer, random copolymer or block copolymer that is amorphous and has a molecular weight below 25,000.

12. The lubricating engine oil of clauses 8-11 further comprising a long chain hydrocarbyl dispersant containing oleophilic portion and polyamino segment.

13. The lubricating engine oil of clauses 8-12 wherein the oil base stock is present in an amount of from 70 weight percent to 95 weight percent, and the metal phosphate nanoplatelets are present in an amount of from 0.1 weight percent to 10 weight percent, based on the total weight of the formulated oil.

14. The lubricating engine oil of clauses 8-13 wherein the lubricating oil is a passenger vehicle engine oil (PVEO).

15. A lubricating engine oil having a composition comprising a lubricating oil base stock as a major component and metal phosphate nanoplatelets as a minor component; wherein said metal phosphate nanoplatelets are dispersed in said lubricating oil base stock sufficient for the lubricating engine oil to exhibit improved wear protection as compared to wear protection achieved using a lubricating oil containing a minor component other than said metal phosphate nanoplatelets.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A method for improving wear protection in an engine lubricated with a lubricating oil by using as the lubricating oil a formulated oil having a HTHS viscosity of less than 4.0 cP at 150° C., said formulated oil having a composition comprising a major amount of a lubricating oil base stock and a minor amount of metal phosphate nanoplatelets; wherein said metal phosphate nanoplatelets are dispersed in said lubricating oil base stock sufficient for the formulated oil to pass wear protection requirements of one or more engine tests selected from TU3M, Sequence IIIG, Sequence IVA and OM646LA, wherein the metal phosphate nanoplatelets comprise alpha zirconium phosphate (ZrP) nanoplatelets.

2. The method of claim 1 wherein the lubricating oil base stock comprises a Group I, Group II, Group III, Group IV or Group V base oil.

3. The method of claim 1 wherein the alpha zirconium phosphate (ZrP) nanoplatelets comprise platy particles having diameters less than 1500 nm.

4. The method of claim 1 wherein the alpha zirconium phosphate (ZrP) nanoplatelets are grafted with a hydrocarbon polymer to form hydrocarbon polymer nanoplates that are dispersed in said lubricating oil base stock.

5. The method of claim 4 wherein the hydrocarbon polymer comprises a homopolymer, random copolymer or block copolymer that is amorphous and has a molecular weight below 25,000.

6. The method of claim 1 wherein said formulated oil further comprises a long chain hydrocarbyl dispersant containing oleophilic portion and polyamino segment.

7. The method of claim 6 wherein the dispersant comprises polyisobutylene succinimide polyamine (PIBSA-PAM).

8. The method of claim 1 wherein the oil base stock is present in an amount of from 70 weight percent to 95 weight percent, and the metal phosphate nanoplatelets are present in an amount of from 0.1 weight percent to 10 weight percent, based on the total weight of the formulated oil.

9. A method of improving wear protection in an engine lubricated with a lubricating oil, said method comprising using as the lubricating oil a formulated oil comprising a lubricating oil base stock as a major component and metal phosphate nanoplatelets as a minor component; wherein said metal phosphate nanoplatelets are dispersed in said lubricating oil base stock; and wherein wear protection is improved as compared to wear protection achieved using a lubricating oil containing a minor component other than said metal phosphate nanoplatelets, wherein the metal phosphate nanoplatelets comprise alpha zirconium phosphate (ZrP) nanoplatelets.

10. A lubricating engine oil having a composition comprising a major amount of a lubricating oil base stock and a minor amount of metal phosphate nanoplatelets; wherein said lubricating engine oil has a HTHS viscosity of less than 2.6 cP at 150° C.; and wherein said metal phosphate nanoplatelets are dispersed in said lubricating oil base stock sufficient for the lubricating engine oil to pass wear protection requirements of one or more engine tests selected from TU3M, Sequence IIIG, Sequence IVA and OM646LA, wherein the metal phosphate nanoplatelets comprise alpha zirconium phosphate (ZrP) nanoplatelets.

11. The lubricating engine oil of claim 10 wherein the base oil comprises a Group I, Group II, Group III, Group IV or Group V base oil.

12. The lubricating engine oil of claim 10 wherein the alpha zirconium phosphate (ZrP) nanoplatelets comprise platy particles having diameters less than 1500 nm.

13. The lubricating engine oil of claim 12 wherein the alpha zirconium phosphate (ZrP) nanoplatelets are grafted with a hydrocarbon polymer to form hydrocarbon polymer nanoplates that are dispersed in said lubricating oil base stock.

14. The lubricating engine oil of claim 13 wherein the hydrocarbon polymer comprises a homopolymer, random copolymer or block copolymer that is amorphous and has a molecular weight below 25,000.

15. The lubricating engine oil of claim 10 further comprising a long chain hydrocarbyl dispersant containing oleophilic portion and polyamino segment.

16. The lubricating engine oil of claim 15 wherein the dispersant comprises polyisobutylene succinimide polyamine (PIBSA-PAM).

17. The lubricating engine oil of claim 10 wherein the oil base stock is present in an amount of from 70 weight percent to 95 weight percent, and the metal phosphate nanoplatelets are present in an amount of from 0.1 weight percent to 10 weight percent, based on the total weight of the formulated oil.

18. A lubricating engine oil having a composition comprising a lubricating oil base stock as a major component and metal phosphate nanoplatelets as a minor component; wherein said metal phosphate nanoplatelets are dispersed in said lubricating oil base stock sufficient for the lubricating engine oil to exhibit improved wear protection as compared to wear protection achieved using a lubricating oil containing a minor component other than said metal phosphate nanoplatelets, wherein the metal phosphate nanoplatelets comprise alpha zirconium phosphate (ZrP) nanoplatelets.

* * * * *